US012686537B2

(12) United States Patent
Culeron et al.

(10) Patent No.: US 12,686,537 B2
(45) Date of Patent: Jul. 21, 2026

(54) LIQUID DISPENSER FOR AN INVERTED CONTAINER

(71) Applicant: The Procter & Gamble Company, Cincinnati, OH (US)

(72) Inventors: Guy Hubert Stephane Sylvain Culeron, Forest (BE); Thierry Christian Francis Dagnelie, Waterloo (BE); Vincent Hubert Monique De Wilde, Holsbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 92 days.

(21) Appl. No.: 18/947,348

(22) Filed: Nov. 14, 2024

(65) Prior Publication Data

US 2025/0162770 A1 May 22, 2025

(30) Foreign Application Priority Data

Nov. 17, 2023 (EP) ..... 23210498
May 14, 2024 (EP) ..... 24175572

(51) Int. Cl.
*B65D 47/20* (2006.01)
*B65D 35/24* (2006.01)

(52) U.S. Cl.
CPC ..... *B65D 47/2031* (2013.01); *B65D 35/245* (2013.01)

(58) Field of Classification Search
CPC ..... B65D 47/2031; B65D 47/043; B65D 47/249; B65D 47/2075; B65D 47/2037; B65D 35/245; B65D 1/32; B65D 51/249
See application file for complete search history.

(56) References Cited

U.S. PATENT DOCUMENTS 4,324,349 A 4/1982 Kaufman
4,811,871 A * 3/1989 Wass ..... G01F 13/006 222/548
6,892,905 B2 * 5/2005 Cousseau ..... G01F 11/262 222/442
9,334,089 B2 * 5/2016 Cardia ..... B65D 47/2018
10,048,106 B2 * 8/2018 Hoefte ..... G01F 11/263
10,071,836 B2 * 9/2018 Holroyd ..... G01F 11/266
10,611,531 B2 * 4/2020 Hoefte ..... B05B 11/048
(Continued)

FOREIGN PATENT DOCUMENTS

JP H02127252 A 5/1990

OTHER PUBLICATIONS

All Office Actions; U.S. Appl. No. 19/089,041, filed Mar. 25, 2025.
(Continued)

*Primary Examiner* — Paul R Durand
*Assistant Examiner* — Randall A Gruby
(74) *Attorney, Agent, or Firm* — Kathleen Y. Carter; Sanaul K. Siddiquee

(57) ABSTRACT

The need for a liquid dispenser and inverted container that provides for improved dosing of liquid compositions, especially at low dosage volumes, while being more resistant to leakage, even for low viscosity liquids, is met by incorporating an impact resistance system into the dispenser, the impact resistance system comprising a wall within, that is higher than the openings that allow ingress of the liquid into the impact resistance system.

20 Claims, 9 Drawing Sheets

(56) References Cited

U.S. PATENT DOCUMENTS

| | | | | |
|---|---|---|---|---|
| 10,844,336 | B2 | 11/2020 | Brouwers et al. | |
| 11,136,160 | B2 * | 10/2021 | Schoubben | B65D 1/0223 |
| 2025/0223086 | A1 * | 7/2025 | Culeron | B65D 47/043 |

OTHER PUBLICATIONS

EPO Search Report and Opinion for 23210498.4 dated Apr. 19, 2024, 09 pages.
EPO Search Report and Opinion for 24175572.7 dated Oct. 21, 2024, 10 pages.
Unpublished U.S. Appl. No. 19/089,041, filed Mar. 25, 2025, to Guy Hubert Stephane Sylvain Culeron et al.

* cited by examiner

LIQUID DISPENSER FOR AN INVERTED CONTAINER

TECHNICAL FIELD

The present disclosure relates to a liquid dispenser for dispensing liquid from an inverted container, and inverted containers comprising them.

BACKGROUND

Containers comprising a spout for dispensing a liquid are well known in the art, especially in the field of dishwashing cleaning products. These bottles have an opening located at the top and are typically referred to as "top-up bottles". In order to dispense the liquid, a consumer typically needs to open a cap to expose the spout, then invert and squeeze the bottle to dispense the liquid. Several problems exist with these top-up bottles. Firstly, the liquid flows out upon inversion of the bottle, even when the bottle is not squeezed making it difficult to control the amount of liquid to be dispensed from the bottle. This may also cause spillage of the liquid when the bottle is turned right side up after use. Secondly, these bottles appear messy as they tend to leave liquid around the rim of the spout. The liquid also tends to dry and forms a crust. If the crust is allowed to build up, then it eventually blocks the spout. Thirdly, the poor ergonomic design of these bottles causes consumer inconvenience. For example, constant twisting of the wrist to dose liquid from the top-up bottles can be uncomfortable or difficult on the consumers, especially with larger sized bottles and/or for the elderly consumers.

Furthermore, dispensing of the last few doses of the liquid composition from top-up bottles can be a time-consuming process, as the composition has to pour down the side of the bottle. Lastly, the presence of a closing cap or seal, which is needed to prevent solvent/other volatiles (e.g., perfumes) from evaporating, requires additional manipulations from the consumers making the bottles not user friendly. All these problems contribute to consumer dissatisfaction with these top-up bottles.

As a result, "inverted containers" have become popular with consumers. Inverted containers have an opening at the "bottom" for dispensing the liquid and are used in the upside-down position. The inverted containers typically rest on their bottom when placed on a horizontal surface. The inverted containers comprise a generally flexible bottle with a capped spout. An improvement to such a system may include a resilient valve in the discharge spout (see for example PCT WO2004/02843 (Method Products), and U.S. Pat. No. 5,213,236A (AptarGroup Inc)). The aim of the valve is to help control the volume of liquid dispensed and minimize leakage with the inverted container so that liquid does not leak out unless force is applied to the containers.

A particular challenge with these types of inverted containers is the prevention of leakage of the liquid contained therein during steady state (i.e., storage) and/or upon impact, especially upon impact. For example, leakage may occur during storage when the inverted container is subjected to a temperature change, specifically increase (e.g., inverted container placed beside sunny window or near stove top, etc.), that can lead to internal pressure increases and leakage. Specifically, by "impact" it is meant that when the inverted container is handled, transported, dropped or knocked over. As a result of the impact, transient liquid pressure increases, also referred to as hydraulic hammer pressure, inside the container and can momentarily force open the valve causing liquid to leak out, which will result in consumer dissatisfaction with the product. Previous attempts to overcome the leakage problem have involved including a closing cap (see for example CN2784322U (Liu Zhonghai) & WO2014/130079 (Dow Global Technologies)). However, inclusion of a closing cap means additional steps of having to open the closing cap for dosing and reclose the closing cap after the dosing process, which is undesirable to consumers. Furthermore, the cap does not avoid liquid messiness and dried up crust of liquid around the spout/cap. Other attempts have incorporated baffles on top of the resilient valve (see for example JP2007/176594 (Lion), & WO2000/68038 (Aptar Group)), which have not completely resolved the leakage issue particularly as it pertains to inverted containers, more particularly upon impact. The need for improved liquid dispensers for an inverted container which substantially reduces or prevents the tendency of the valve to open when the inverted container is impacted, particularly dropped or knocked over has been met through the use of dispensers as described in EP3492400B1 and EP3511402B1. However, it remains challenging to dose accurate quantities of the liquid composition, contained within the inverted container, especially for small dose sizes. This is because the valve contained within the dispenser typically has an opening pressure, above which, the liquid is dispensed. Once the opening pressure is achieved, the valve typically opens suddenly, releasing the pressure before closing, and hence causing spurting of the liquid contained therein. Moreover, leak prevention remains challenging for bottom dispensing containers, especially bottom dispensing containers comprising a liquid having a low viscosity. JPH02127252A seeks to prevent liquid from leaking by providing a liquid path for discharging liquid from a device on a body, wherein a passage part having a first opening opened at an opening end and a second opening located above the opening end are included so that liquid is guided upward from the opening end at a mouth part.

Therefore, the need remains for such dispensers which also provide improved dosing of liquid compositions, especially at low dosages, while also providing improved leakage prevention, especially when comprising liquids having a low viscosity.

SUMMARY

The present disclosure relates to a liquid dispenser for affixing to an inverted container containing dispensable liquid, the dispenser comprising: a body of the dispenser comprising a connecting sleeve, wherein the connecting sleeve is adaptable for engaging to an exterior surface proximate an opening of the inverted container and is spaced radially inwardly to define an internal discharge conduit for establishing fluid communication with the liquid contained in the inverted container; a valve localized in the body extending across the internal discharge conduit, the valve having an interior side for being contacted by the liquid contained inside the inverted container and an exterior side for being exposed to the exterior atmosphere, wherein the valve defines a dispensing orifice that is reactably openable when the pressure on the valve interior side exceeds the pressure on the valve exterior side; and an impact resistance system localized upstream of the valve, the system comprises: a housing having a cavity therein and extending longitudinally from the body and radially inwardly from the sleeve; and a wall positioned radially inwardly from the housing, extending longitudinally from the body, and extending around the valve, wherein the housing comprises at least one inlet opening that provides a flow path for the liquid from the inverted container into the housing, and at least one outlet opening that provides a path of egress for the liquid from the housing to the exterior atmosphere when the dispensing orifice is opened, wherein the cavity is adapted to be partially occupied by a compressible substance, wherein the at least one inlet opening is proximal to the body, wherein the at least one inlet opening has an inlet opening height, wherein the wall extends longitudinally from the body an overlap distance further than the lower edge (38) of the at least one inlet opening, wherein the ratio of the overlap distance to the inlet opening height is 1.25 or higher.

BRIEF DESCRIPTION OF THE DRAWINGS

While the specification concludes with claims particularly pointing out and distinctly claiming the examples of the present disclosure, it is believed that the examples of the present disclosure will be better understood from the following description of the accompanying figures wherein like numerals are employed to designate like parts throughout the same:

DETAILED DESCRIPTION

Figure 1:
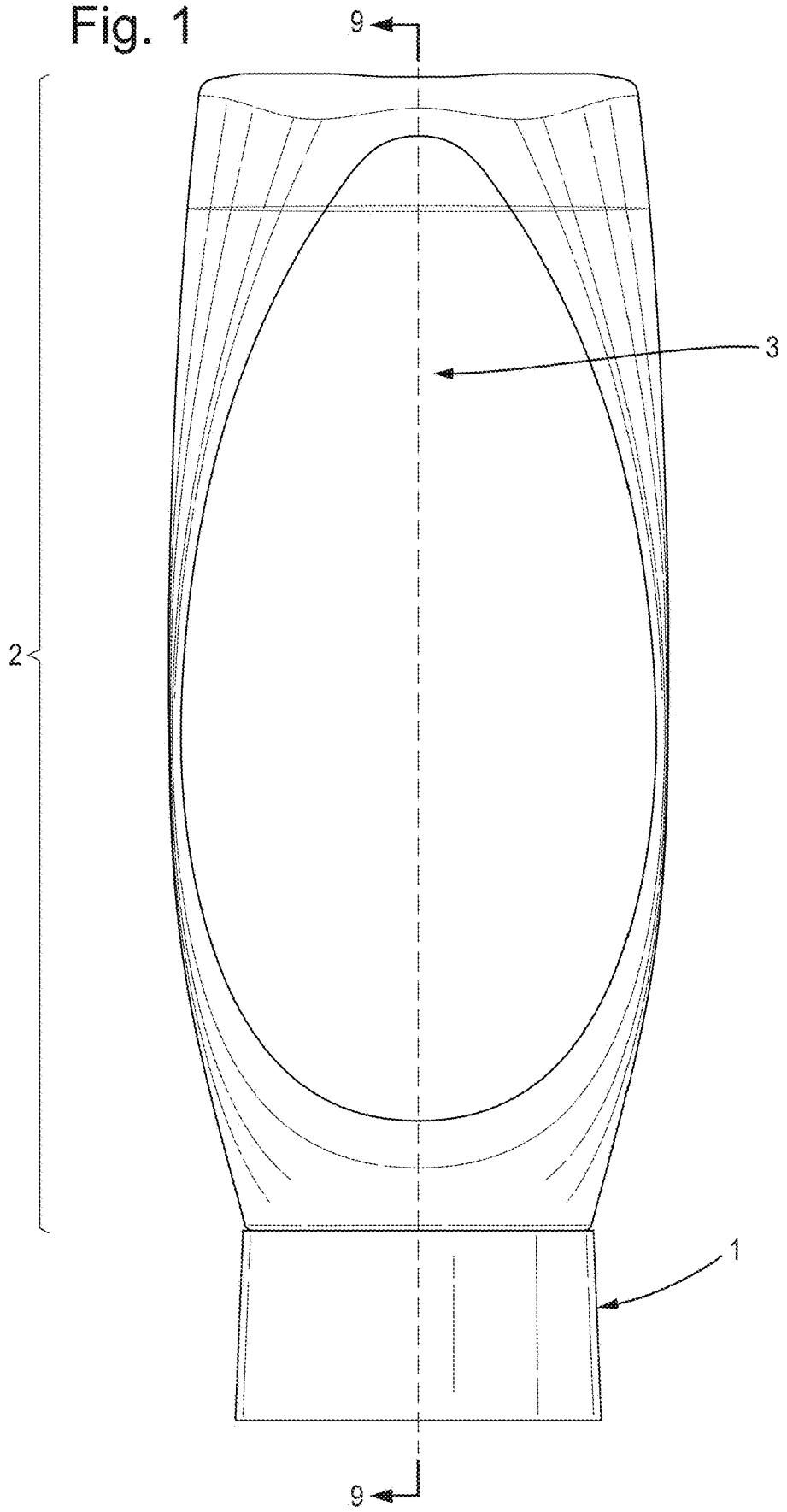
FIG. 1 shows a perspective view of a liquid dispenser (1) according to one aspect of the present disclosure connected to an inverted container (2), the container comprising sidewalls (3). Also shown is section line 9-9.

The present disclosure provides a liquid dispenser as described herein which can substantially reduce or prevent the tendency of the valve to open when the inverted container is impacted, particularly dropped or knocked over, so that the liquid does not leak out, while also providing more accurate dosing, especially at low dose sizes, and improved leakage prevention especially for liquids having a low viscosity.

Another aim of the present disclosure is to provide a liquid dispenser as described herein which prevents steady state leakage of the liquid. It is advantageous that the valve remains closed during storage of the inverted container so that the liquid does not leak out unless force is intentionally applied to the inverted container to dispense the liquid. This avoids messy dried liquid forming near the dispensing orifice, which can potentially block the liquid from being dispensed, or messiness in the storage area leading to eventual surface damage when stored on delicate surfaces. The sensitivity to leakage is especially reduced under static storage conditions when storing low viscosity liquids.

A further aim of the present disclosure is to provide a liquid dispenser as described herein that allows for ease and accurate dosing without needing to turn the containers over. This is believed to contribute to faster and improved ergonomical dosing experience (i.e., more comfortable, less stress on the wrist, less strength needed, etc.). For example, less steps are required then with conventional top-up bottles or upside-down containers that may include a closing cap or seal, and no awkward twisting motion of the hands is needed to invert the bottle upside down to dispense the liquid.

Yet a further aim of the present disclosure is to provide a liquid dispenser as described herein that would allow access to every last drop of the liquid inside the inverted containers. Thus, it is an advantage of the examples of the present disclosure to minimize waste.

The present disclosure also has the advantage of allowing for a larger formulation window of operable viscosity since formulators can now include liquids having a larger viscosity range, particularly liquids having lower viscosities which tend to be more sensitive to leakage.

Another advantage of the present disclosure is that it allows for use with larger sized containers (e.g., greater than 450 mL). It is expected that the improved liquid dispenser enables higher weight tolerances on the resilient valve thereby substantially reducing/preventing liquid leakage when used with larger inverted containers.

These and other features, aspects and advantages of the present disclosure will become evident to those skilled in the art from the detailed description which follows.

It is to be understood that the scope of the claims is not limited to the specific devices, apparatuses, methods, conditions or parameters described and/or shown herein, and that the terminology used herein is for the purpose of describing particular aspects of the examples of the present disclosure by way of examples only and is not intended to be limiting of the claimed examples.

As used herein, articles such as "a" and "an" when used in a claim, are understood to mean one or more of what is claimed or described.

As used herein, any of the terms "comprising", "having", "containing", and "including" means that other steps, ingredients, elements, etc. which do not adversely affect the end result can be added. Each of these terms encompasses the terms "consisting of" and "consisting essentially of". Unless otherwise specifically stated, the elements and/or equipment herein are believed to be widely available from multiple suppliers and sources around the world.

As used herein, the term "compressible" means the ability of a substance to reduce volume under influence of increased pressure, in which the volume reduction is at least 1%, preferably at least 5%, most preferably at least 10%.

As used herein, the term "consumers" is meant to include the customers who purchase the product as well as the person who uses the product.

As used herein, the term "hydraulic hammer pressure" means a transient pressure increase caused when the liquid inside the inverted container is forced to stop or change direction suddenly (i.e., momentum change) typically as a result of impact to the inverted container. Hydraulic hammer pressure can also be referred to as "impact force". If the hydraulic hammer pressure is not somehow absorbed by the liquid dispenser, then the force might (momentarily) open the valve and cause leakage of the liquid.

The terms "include", "includes" and "including" are meant to be non-limiting.

As used herein, the term "liquid" means any liquid including highly viscous materials (e.g., lotions and creams), suspensions, mixtures, etc. For example, a "liquid" may constitute a personal care product, a food product (e.g., ketchup, mayonnaise, mustard, honey, etc.), an industrial or household cleaning product (e.g., laundry detergent, dish washing cleaning detergent, etc.), or other compositions of matter (e.g., compositions for use in activities involving manufacturing, commercial or household maintenance, personal/beauty care, baby care, medical treatment, etc.). Key targeted liquid is a hand dishwashing liquid detergent. The liquid product preferably the liquid detergent product, more preferably the liquid hand dishwashing product may have any density, however the liquid preferably has a density between 0.5 g/mL and 2 g/mL, more preferably between 0.8 g/mL and 1.5 g/mL, most preferably between 1 g/mL and 1.2 g/mL.

As used herein, the term "steady state" means the constant pressure properties of the liquid inside the container when it is at rest.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "1.2 cm" is intended to mean "about 1.2 cm".

It is understood that the test methods that are disclosed in the Test Methods Section of the present application must be used to determine the respective values of the parameters of Applicants' examples as described and claimed herein.

In all examples of the present disclosure, all percentages are by weight of the total composition, as evident by the context, unless specifically stated otherwise. All ratios are weight ratios, unless specifically stated otherwise, and all measurements are made at 25° C., unless otherwise designated.

Liquid Dispenser

Figure 9:
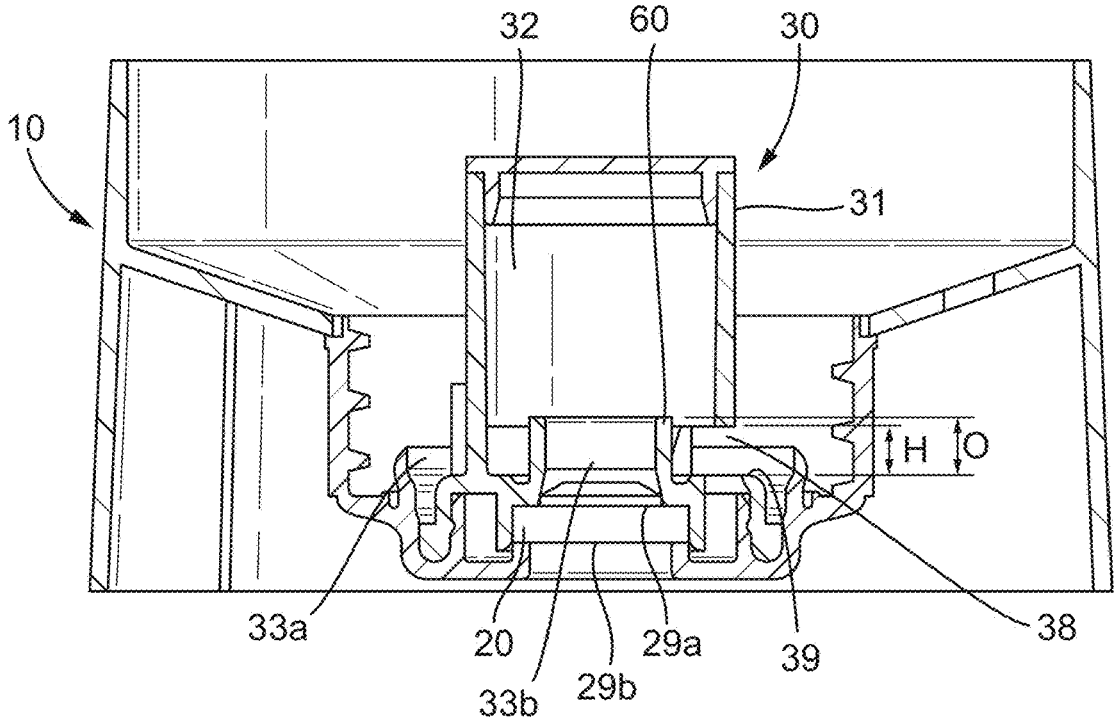
FIG. 9 shows a cross-sectional view of the impact resistance system (30) of FIG. 7, connected to a body (10). Also shown are the upper retainer surface (29*a*) and lower retainer surface (29*b*) for securing the valve (20). Also shown is the graphical representation of the inlet opening height (H) and the overlap distance (O).
Figure 12:
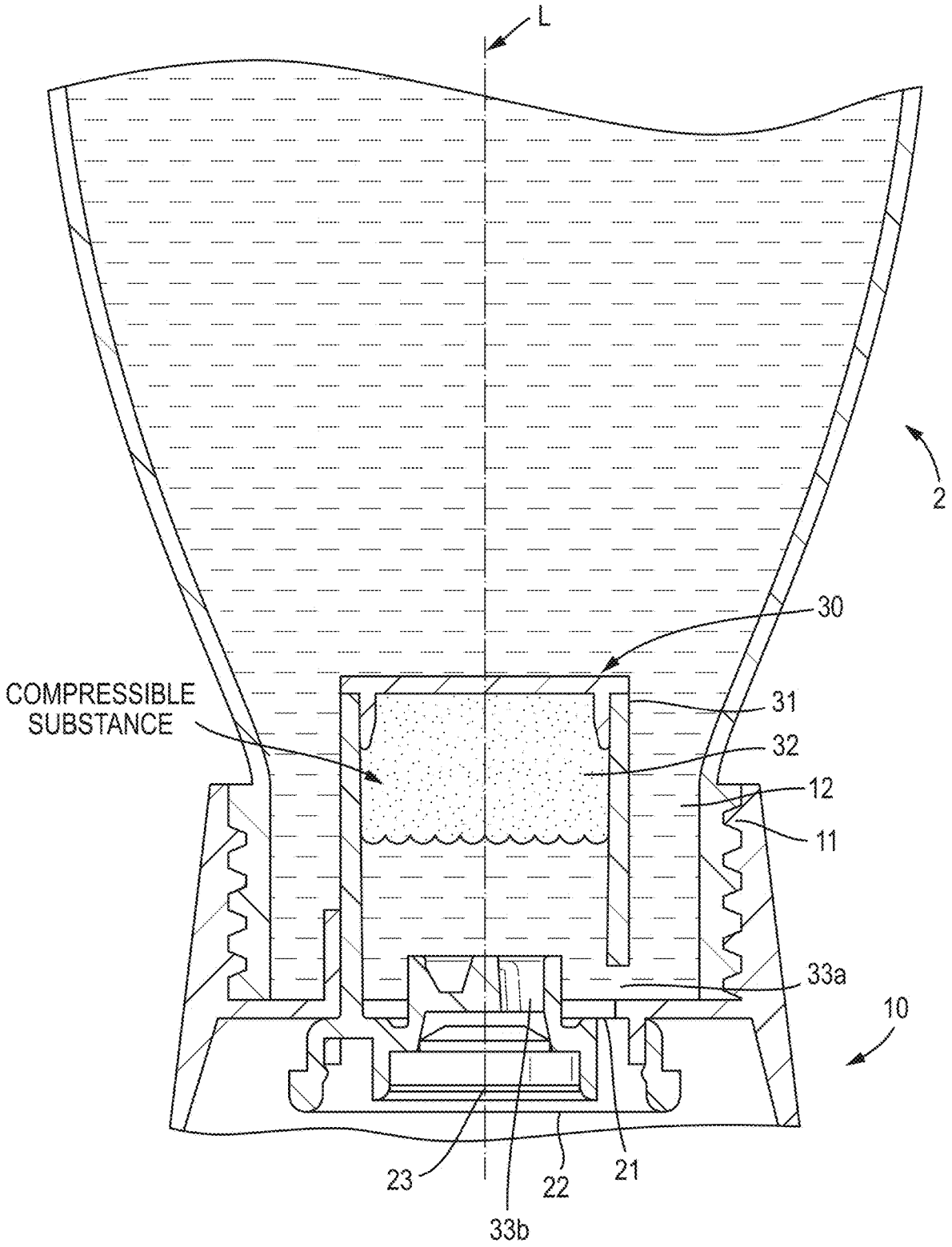
FIG. 12 shows a cross sectional view of the liquid dispenser (1) of FIG. 1 taken along section line 9-9, including the impact resistance system (30) of FIG. 10, and in which the valve defines the dispensing orifice (23).

For ease of description, the liquid dispenser (1) of the present disclosure is described with terms such as upper/top, lower/bottom, horizontal, etc. in reference to the position show in FIG. 1. With continued reference to FIGS. 1 and 12, it will be understood however, that the liquid dispenser (1) of the present disclosure is used with an inverted container (2) wherein the liquid is dispensed from the bottom of the inverted container (2). The liquid dispenser (1) can be affixed, preferably releasably affixed, to an inverted container (2). As such, the liquid dispenser (1) preferably comprises a means of affixing to an inverted container, such as a screw thread (as shown in FIGS. 9 and 12), or one half of a lock-and-key mechanism, or surfaces for adapted for gluing or heat-sealing.

Figure 2:
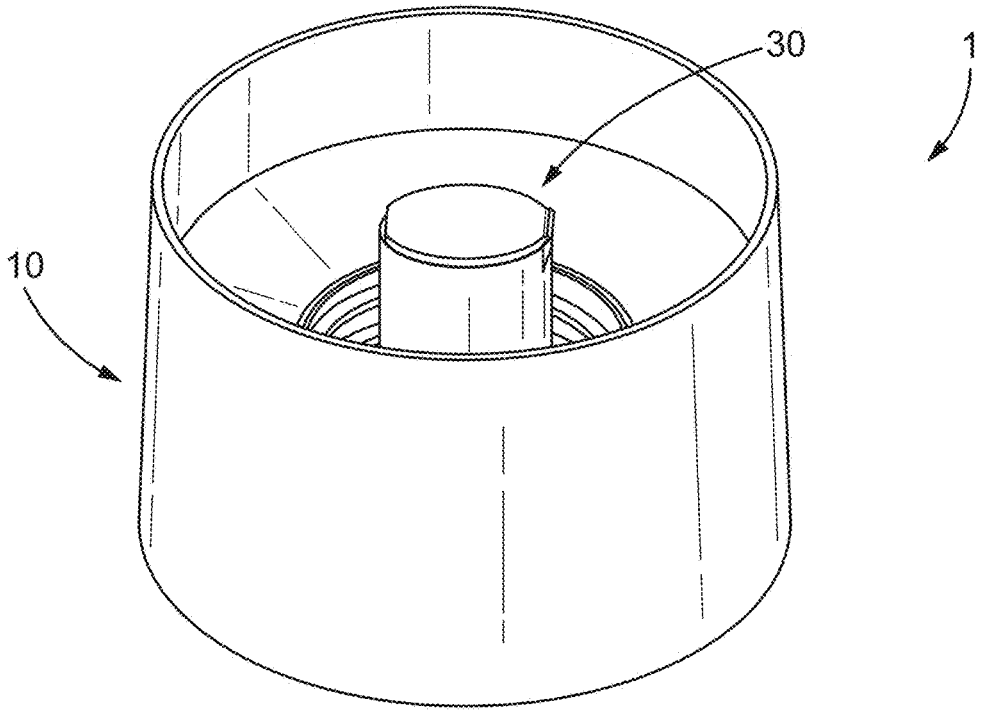
FIG. 2 shows a perspective view of a liquid dispenser (1) according to one aspect of the present disclosure, comprising the body (10) and the impact resistance system (30).

The liquid dispenser (1), or at least certain components of the dispenser (1), can be made from any materials which can be molded or shaped, while still being durable enough to hold up to being transported and regular wear and tear with constant exposure to a liquid. The dispenser (1) components may be separately molded and may be molded from different materials. The materials for the different components, unless specifically specified, may have the same or different colors and textures for aesthetic purposes. Preferably, the components are molded from a hard plastic, more preferably a thermoplastic material, such as for example, polypropylene (PP), polycarbonate, polyethylene (PE), polyvinylchloride (PVC) or the like. One or more of the components of the liquid dispenser may also partially or fully comprise post-consumer recycled materials from bottles, other containers and the like. As shown in FIG. 2, the liquid dispenser (1) comprises three basic components, a body (10), a valve (20) (not shown) and an impact resistance system (30). Preferably the liquid dispenser (1) is free of a closing cap or seal. Typically the seal is included for transport and is removed and discarded after the first use of the liquid dispenser (1).

Body

Figure 3:
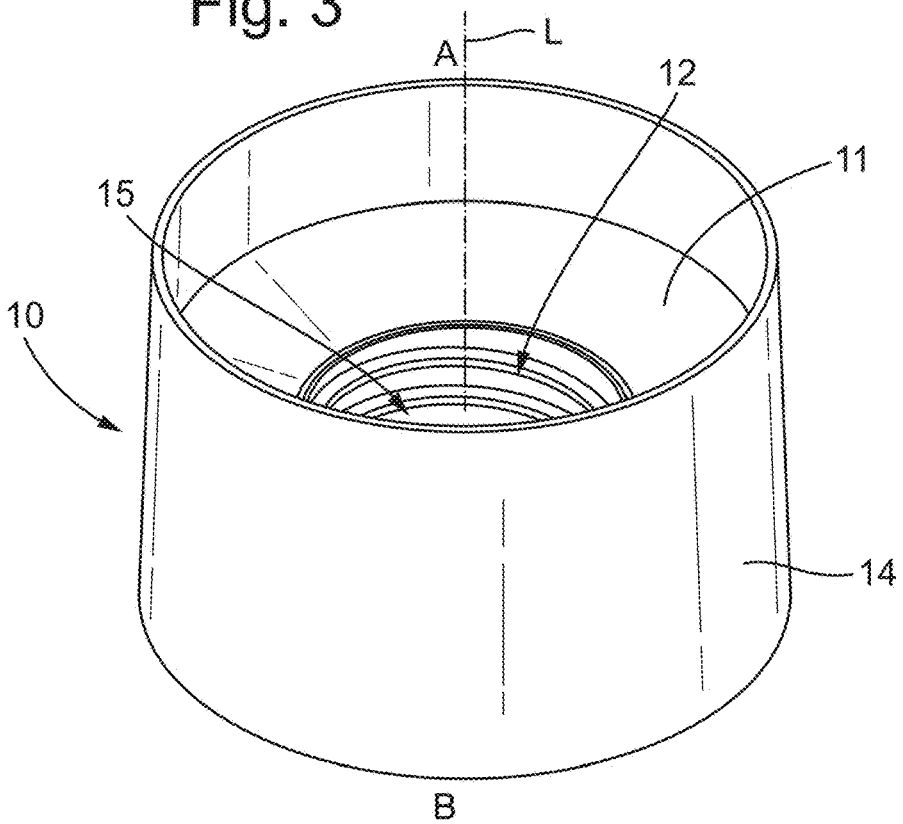
FIG. 3 shows a perspective view of a body (10) of use in the liquid dispenser (1) according to the present disclosure, before the impact resistance system (30) has been incorporated. Also shown are the connecting sleeve (11), the internal discharge conduit (12), the exterior portion (14) and the central portion (15) of the body (10), as well as the top end (A) and bottom end (B).

As shown in FIG. 3, the liquid dispenser (1) comprises a body (10). The body (10) includes at a top end (A) a connecting sleeve (11) adapted for releasably engaging to an exterior surface proximate an opening (5) (not shown) of the inverted container (2). Preferably this arrangement provides leak-tight contact between the liquid dispenser (1) and the inverted container (2) making the liquid dispenser (1) sealingly tight against leakage. Alternatively, the connecting sleeve (11) may be adapted for releasably engaging to an interior surface proximate an opening (5) (not shown) of the inverted container (2). In other words, the inverted container (2) is attached to the connecting sleeve (11) located on the horizontal exterior of the body (10) of the liquid dispenser. However this alternative arrangement is less preferred since there is a higher leakage risk of liquid passing through the contacts between the dispenser (1) and the inverted container (2).

The body (10) can be releasably engaged to the opening (5) (not shown) of the inverted container (2) by suitable means of attachment commonly known to those skilled in the art, including for non-limiting example co-operative threads, crimping, clipping means, clasp-means, snap-fit means, groove arrangements, bayonet fittings, or permanently welded. Preferably, the male thread on the exterior surface of the opening (5) (not shown) of the inverted container (2) is screwed on the female thread which has been molded onto the connecting sleeve (11) (as illustrated in FIG. 3).

The body (10) includes a central portion (15) axially disposed along the longitudinal axis (L). The connecting sleeve (11) is spaced radially inwardly towards the central portion (15) and defines an internal discharge conduit (12). The discharge conduit (12) functions as a flow passage for establishing fluid communication with the liquid contained in the inverted container (2) to the exterior atmosphere. It will be understood that in use, the connecting sleeve (11) forms a fluid seal between the liquid dispenser (1) and the inverted container (2) so that the liquid can enter the liquid dispenser (1) without leaking.

Preferably, the body (10) comprises at a bottom end (B) an exterior portion (14) adapted to allow the inverted container (2) to stably rest on its bottom on a flat surface (as shown in FIG. 1). The exterior portion (14) may be integrally formed with the body (10). For example, the exterior portion (14) comprises an annular flange structure (e.g., skirt) that extends axially downward towards the bottom (B) and radially outward as shown in FIG. 3. While FIG. 3 depicts the exterior portion (14) of the body (10) as having a frustoconical shape, it is not necessarily limited to this shape. Other shapes such as cylindrical, pyramid shape, disk shape, multiple legs, etc. could be used so long as they allow for the inverted container (2) to remain stably rested on its bottom.

It should be understood that while the body (10) has been shown and described herein, there are many variations that may be desirable depending on the particular requirements. For example, while the connecting sleeve (11) and the exterior portion (14) have been shown as having uniform material thickness, in some applications it may be desirable for the material thickness to vary. By way of further example, while a number of surfaces have been described herein as having a specific shape (e.g., frustoconcial, planar, etc.) other specific shapes may be desirable for those surfaces depending upon the particular application.

Valve

Figure 4:
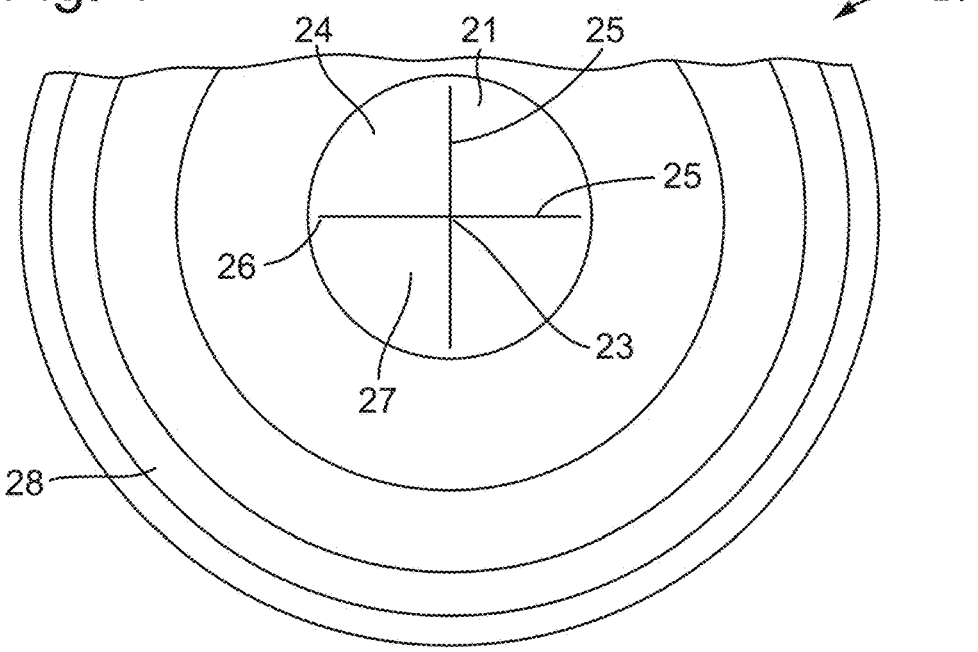
FIG. 4 shows a top view of the interior side (21) of a valve (20) of use in the liquid dispenser (1) according to the present disclosure. Also shown are the dispensing orifice (23), as well as the components of the dispensing orifice: the flexible central portion (24), the slits (25), distal ends (26) of the slits (25) and the flaps (27) formed by the slits (25).
Figure 5:
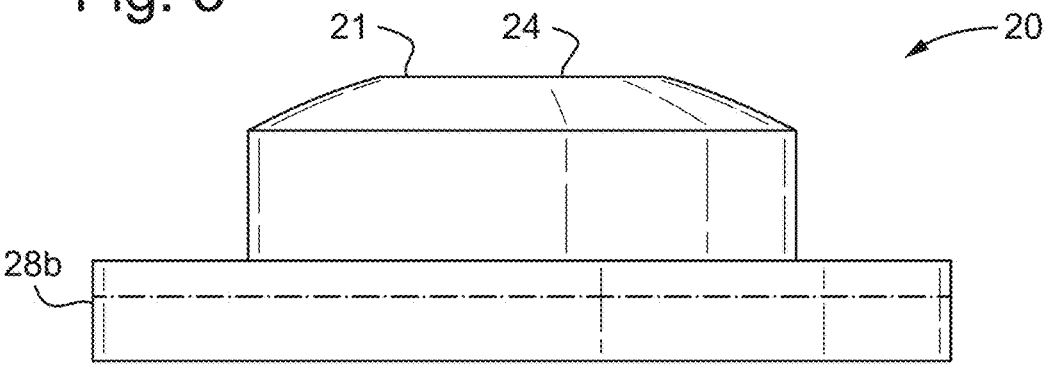
FIG. 5 shows a plan side view of the valve (20) of FIG. 4, further showing the outer edge (28*b*) of the marginal flange of the valve (20).
Figure 6:
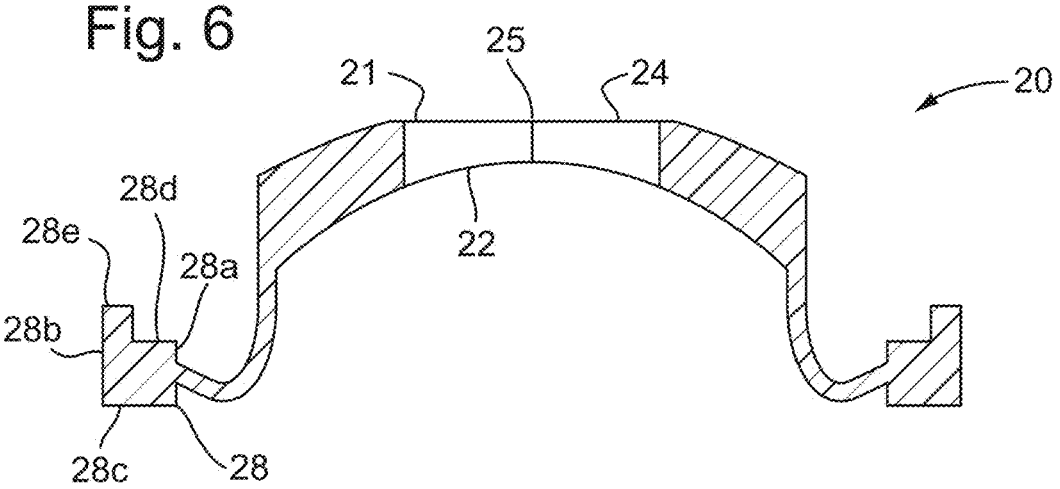
FIG. 6 is a section view of the valve (20) of FIG. 4, further showing the valve exterior side (22), in addition to the inner edge (28*a*), the outer edge (28*b*), the bottom (28*c*), and the top (28*d*) with the outer rim (28*e*) of the marginal flange (28).

The liquid dispenser (1) further comprises a valve (20) localized in the body (10) extending across the internal discharge conduit (12). As shown by FIGS. 4 to 6, the valve (20) has an interior side (21) for being contacted by the liquid contained inside the inverted container (2) and an exterior side (22) (as shown in FIG. 6) for being exposed to the exterior atmosphere. The valve (20) defines a dispensing orifice (23) that is reactably openable when the pressure on the valve interior side (21) exceeds the pressure on the valve exterior side (22).

The valve (20) is preferably a flexible, elastomeric, resilient, 2-way bi-directional, self-closing, slit-type valve mounted in the body (10). The valve (20) has slit or slits (25) which define the dispensing orifice (23). For example, the dispensing orifice (23) may be formed from one slit (25) or two or more intersecting slits (25), that may open to permit dispensing of liquid therethrough in response to an increased pressure inside the inverted container (2), such as for example, when the inverted container (2) is squeezed. The valve (20) is typically designed so as to reactably close the dispensing orifice (23) and stop the flow of liquid therethrough upon a reduction of the pressure differential across the valve (20). The amount of pressure needed to keep the valve (20) in the closed position will partially depend on the internal resistance force of the valve (20). The "internal resistance force" (i.e., cracking-pressure) refers to a predetermined resistance threshold to deformation/opening of the valve (20). In other words, the valve (20) will not tend to resist deformation/opening so that it remains closed under pressure of the steady state liquid bearing against the interior side (21) of the valve (20). The amount of pressure needed to deform/open the valve must overcome this internal resistance force. This internal resistance force must not be too low so as to cause liquid leakage or too high to make dispensing a dose of liquid difficult. Accordingly, the valve (20) preferably has an internal resistance force of the valve (20) that is at least 10 mbar, preferably at least 25 mbar, more preferably less than 250 mbar, even more preferably less than 150 mbar, most preferably less than 75 mbar. Preferably, the dispensing orifice (23) is designed to be in the open position when a pressure difference (4) of at least 10 mbar, preferably at least 25 mbar exists between the valve interior side (21) in relation to the valve on the exterior side (22). Preferably the force exerted on the valve interior side (21) that is required in order to open the dispensing orifice (23) is at least 10 mbar, preferably at least 25 mbar. Preferably the valve (20) has a surface area of between 0.1 $cm^2$ and 10 $cm^2$, more preferably between 0.3 $cm^2$ and 5 $cm^2$, most preferably between 0.5 $cm^2$ and 2 $cm^2$. Preferably the valve (20) has a height of between 1 mm and 10 mm, more preferably between 2 mm and 5 mm. Other dimensions could be used so long as they allow for the dispensing orifice (23) to remain in the fully closed position at rest.

As shown in FIGS. 4 to 6, the valve (20) preferably includes a flexible central portion (24) having at least one, preferably at least two, alternatively a plurality (i.e., three or more), of planar, self-sealing, slits (25) which extend radially outward towards distal ends (26). It should be understood that slit valve is intended to refer to any valve that has one or more slits in its final functioning form, including such valve wherein one or more of the slits, is/are only fully completed after the valve has been formed and/or installed in the liquid dispenser (1). Each slit (25) preferably terminates just before reaching the distal end (26) in the valve (20). Preferably, the slits (25) are straight (as shown in FIG. 4) or may have various different shapes, sized and/or configurations (not shown). Preferably, the intersecting slits (25) are equally spaced from each other and equal in length.

The valve (20) is typically designed to close the internal discharge conduit (12) and stop the flow of liquid through the conduit (12) upon a reduction of the pressure differential across the valve (20). The amount of pressure needed to open the valve (20) will partially depend on the internal resistance force of the valve (20). The "internal resistance force" (i.e., cracking-pressure) refers to a pre-determined resistance threshold to deformation/opening of the valve (20). In other words, the valve (20) will tend to resist deformation/opening so that it remains closed under pressure of the steady state liquid bearing against the interior side (21) of the valve (20). The amount of pressure needed to deform/open the valve (20) must overcome this internal resistance force. This internal resistance force should not be so low as to cause liquid leakage. Accordingly, the valve (20) preferably has an opening pressure differential from the interior side (21) to the exterior side (22) of the valve (20) of at least 10 mbar, preferably at least 15 mbar, more preferably at least 25 mbar, measured at 20° C. The internal resistance force should not be so high as to make dispensing a dose of liquid difficult.

Especially where the inverted container (2) comprises a low viscosity liquid, the use of a valve (20) which opens at a relatively low-pressure differential helps to avoid spurting of the composition through the valve (20). The valve (20) preferably opens at a pressure differential of from 10 to 250 mbar, preferably from 15 to 150 mbar, more preferably from 25 to 75 mbar, measured at 20° C.

Moreover, the use of a valve (20) which opens at such low-pressure differentials also means that a smaller pressure differential is required to draw air through the valve (20) once the squeezing has been removed, so that the container (2) can return to its original shape. This is particularly important for inverted containers (2) which comprise a more elastic container (2) since an insufficient pressure differential across the valve (20) means that not enough air is drawn through the valve (20) and into the container (2) for the container (2) to revert back to its undeformed shape.

The opening pressure differential (in mbar) is typically measured using a water column, to which the slit-valve has been sealingly attached to the bottom of the water-column, then measuring the water-height required to open the slit valve, at the target temperature. The opening pressure is typically available from the valve manufacture, including on technical literature provided for the valve.

With continued reference to FIG. 4, the intersecting slits (25) define four, generally sector-shaped, equally sized flaps (27) in the valve (20). The flaps (27) may be characterized as the openable portions of the valve (20) that reacts to pressure differences to change configuration between a closed, rest position (as shown in FIG. 4) and an open position. The valve (20) is designed to be flexible enough to accommodate in-venting of exterior atmosphere. For example, as the valve (20) closes, the closing flaps (27) or openable portions can continue moving inwardly and pass the closed position to allow the valve flaps (27) to open inwardly when the pressure on the valve exterior side (22) exceeds the pressure on the valve interior side (21) by a predetermined magnitude. Such in-venting capability of the exterior atmosphere helps equalize the interior pressure inside the inverted container (2) with the pressure of the exterior atmosphere. It is understood that the valve (20) is designed so that the opening pressure to vent air back into the inverted container (2) is low enough to avoid paneling of the inverted container (2) during use. In other words, the resilience of the inverted container (2) to return to its initial shape after use (i.e., squeezing force) is higher than the venting opening pressure.

Preferably the valve (20) is not contacting the surface on which the inverted container (2) is standing when at rest, nor contacting the surface to be cleaned upon dosing. Heretofore the valve (20) is augmented into the body (10), preferably being positioned at least 1 mm from the resting surface, more preferably at least 5 mm, even more preferably at least 1 cm. By positioning the valve (20) above rather than in contact with the surface there is less risk of capillary seeping through the valve (20) leading to surface contamination and potentially surface damage upon storage of the inverted container (2).

The valve (20) is preferably molded as a unitary structure from materials which are flexible, pliable, elastic and resilient. Suitable materials include, such as for example, thermosetting polymers, including silicone rubber (available as D.C. 99-595-HC from Dow Corning Corp., USA; WACKER 3003-40 Silicone Rubber Material from Wacker Silicone Co.) preferably having a hardness ration of 40 Shore A, linear low-density polyethylene (LLDPE), low density polyethylene (LDPE), LLDPE/LDPE blends, acetate, acetal, ultra-high-molecular weight polyethylene (UHMW), polyester, urethane, ethylene-vinyl-acetate (EVA), polypropylene, high density polyethylene or thermoplastic elastomer (TPE). The valve (20) can also be formed from other materials such as thermoplastic propylene, ethylene and styrene, including their halogenated counterparts. Suitable valves are commercially available such as from the APTAR Company including the SimpliSqueeze® valve line up.

Figure 10:
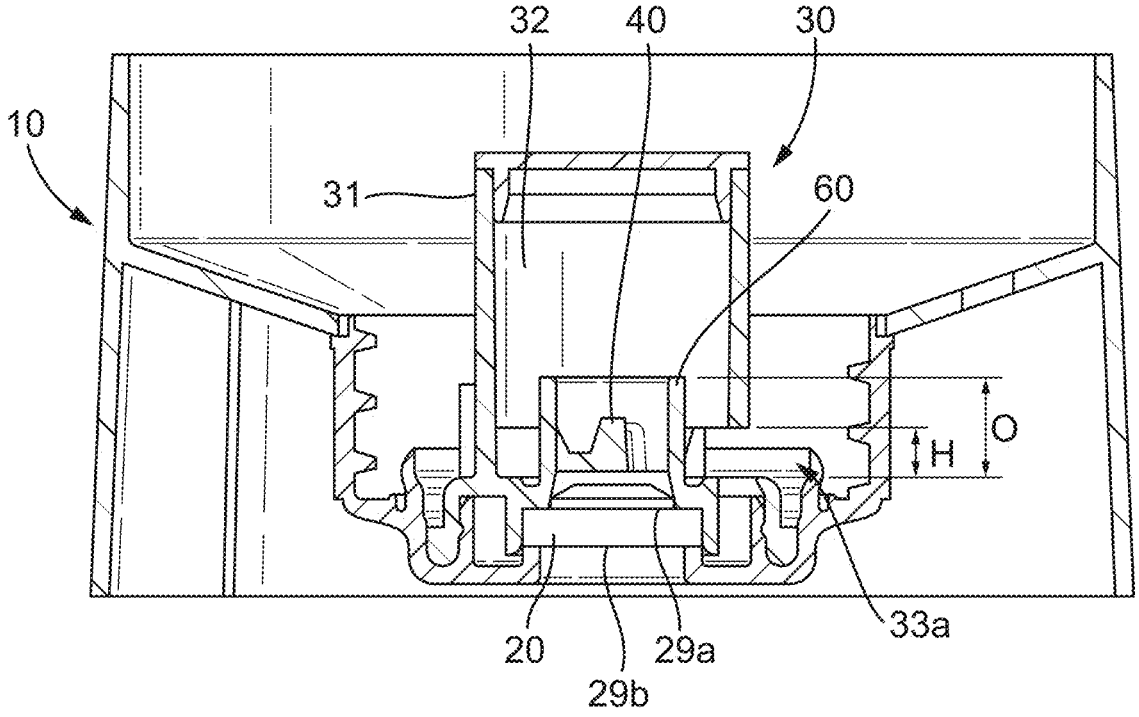
FIG. 10 shows a cross-sectional view of the impact resistance system (30) similar to that of FIG. 7, but further comprising a baffle (40).
Figure 11:
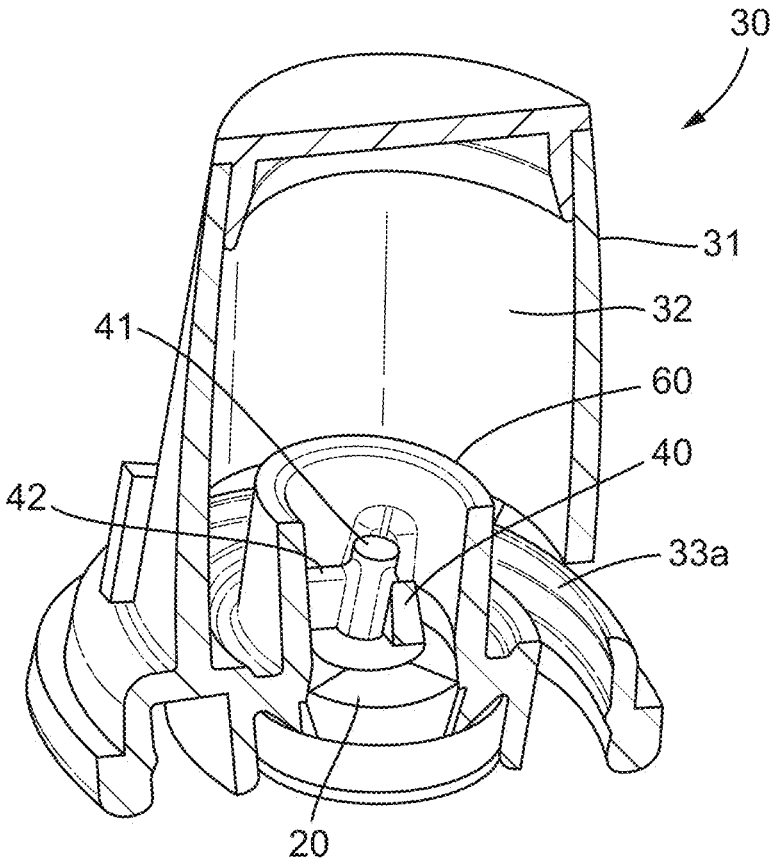
FIG. 11 shows an angled cross-sectional view of the impact resistance system (30) of FIG. 10, showing the baffle (40) in perspective view, as well as its occlusion member (41) supported by support members (42).

As shown in FIGS. 8 to 11, the valve (20) can be localized in the body (10) or impact resistance system (30) to provide the dispensing orifice (23). As shown in FIGS. 9 and 10, the valve (20) is preferably localized in the body (10), below the outlet opening (33*b*) and provides the path of egress for the liquid from the housing (31) to the exterior atmosphere when the dispensing orifice (23) is opened.

As shown in FIGS. 4 to 6, the valve (20) typically includes a marginal flange (28) which seals about the dispensing orifice (23), in addition to the central portion (24). The marginal flange (28) typically has an annular plan shape and a substantially L-shaped cross-sectional configuration, comprising an inner edge (28*a*), an outer edge (28*b*), a bottom (28*c*), and a top (28*d*) with an outer rim (28*e*) upstanding therefrom. The marginal valve flange (28) has substantial thickness between the bottom (28*c*) and top (28*d*) which is resiliently compressed between an upper retainer surface (29*a*) and a lower retainer surface (29*b*) to form a secure leak-resistant seal therebetween (see FIGS. 9 and 12). If present, the outer rim portion (28*e*) of marginal flange (28) positively locks the valve (20) to prevent any radial movement.

As shown in FIGS. 9 and 10, the lower retainer surface (29*b*) can be formed as part of the body (10) or housing (31), preferably the body (10). The upper retainer surface (29*a*) is fixedly mounted to, or forms part of the body (10) or housing (31), preferably the housing (31).

The valve (20) is normally in the closed position and can withstand the pressure of the liquid inside the inverted container (2) so that the liquid will not leak out unless the inverted container (2) is squeezed. Unfortunately, the design of the valve (20) limits their effectiveness in preventing liquid leakage from inside the inverted container (2) under all situations, particularly when the inverted container (2) has been impacted causing a substantial transient liquid pressure increase. The impact resistance system, as described in EP3492400B1 helps to absorb the transient liquid pressure increase after the impact and substantially reduce or prevent liquid leakage from the liquid dispenser (1). The present improvements to the impact resistance system (30) improve both the leakage resistance from transient liquid pressure increases after impact, as well as the leakage resistance for pressure changes during storage, especially for lower viscosity liquids. The present improvements to the impact resistance system (30) also improve control of the dosage of the liquid compositions contained therein.

Impact Resistance System

Figure 7:
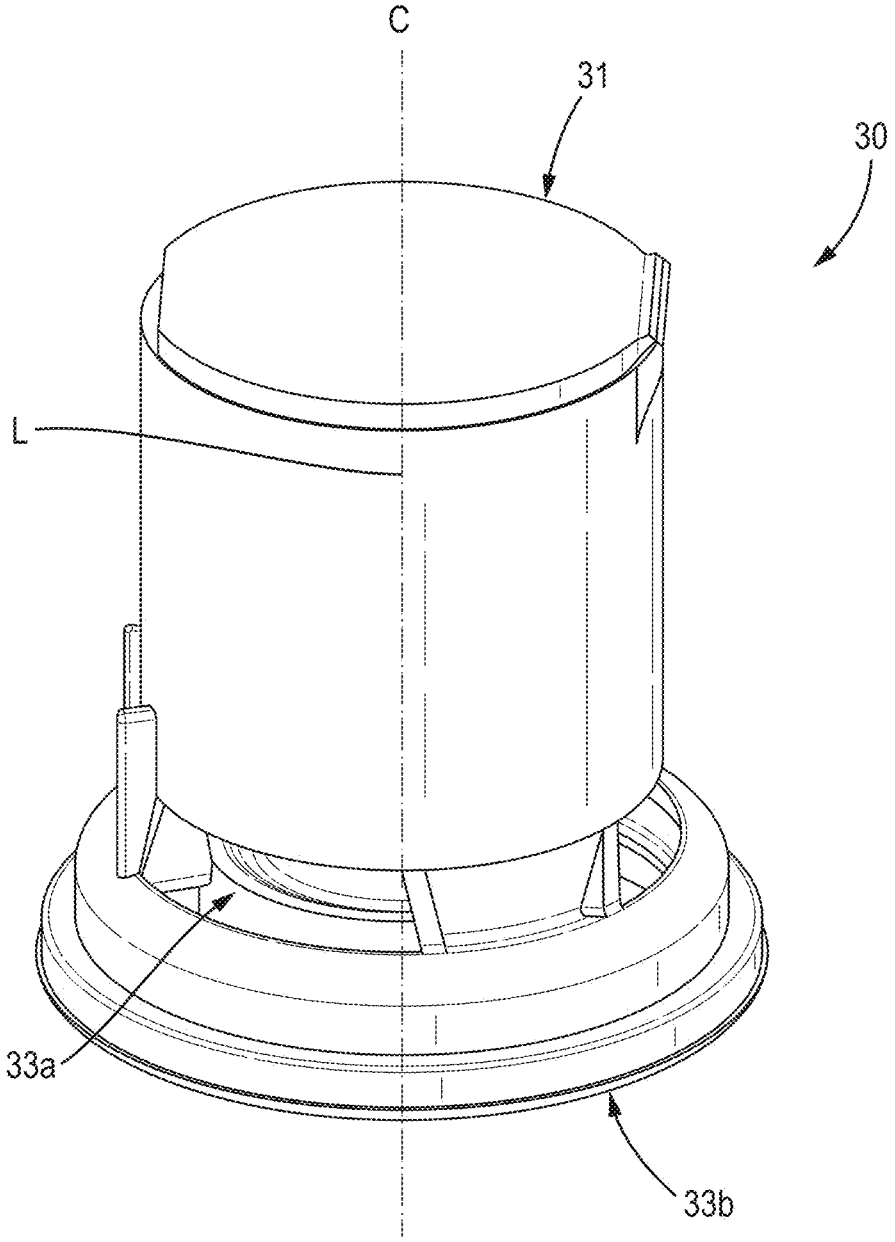
FIG. 7 shows a perspective view of an impact resistance system (30) of use in the liquid dispenser (1) according to the present disclosure. Also shown is the housing (31), the inlet openings (33*a*) and the position of the outlet opening (33*b*).
Figure 8:
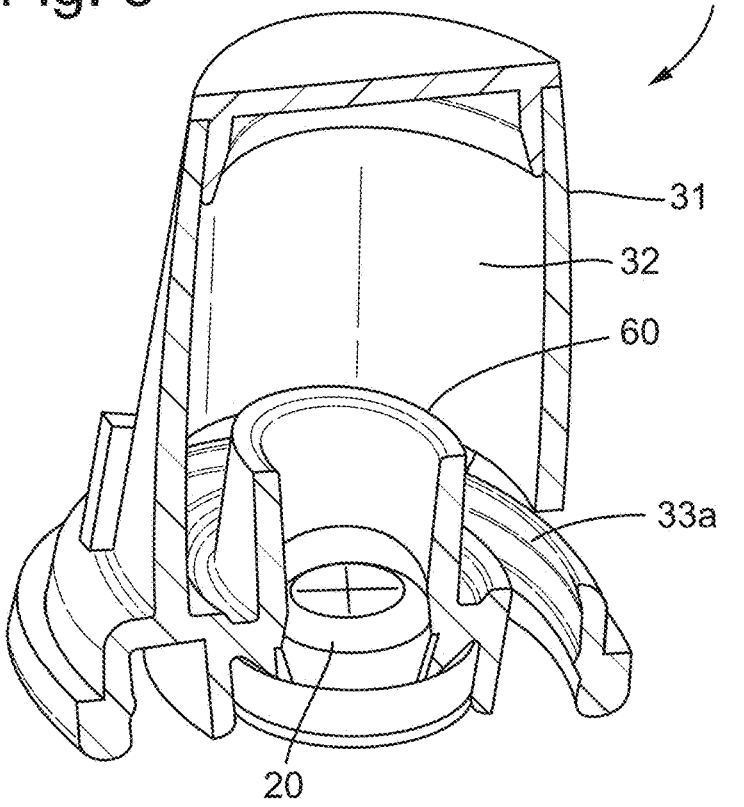
FIG. 8 shows an angled cross-sectional view of the impact resistance system (30) of FIG. 7. Also shown is the valve (20), the cavity (32) and the wall (60).

According to the present disclosure, the liquid dispenser (1) further comprises an impact resistance system (30) (as shown in FIG. 7) localized upstream of the valve (20). The system (30) comprises a housing (31) having a cavity (32) therein, as shown in FIGS. 8 to 12. The housing (31) extends longitudinally from the body (10) radially inward from the sleeve (11). That is, in a direction parallel to axis "L", as shown in FIG. 3. The housing (31) is a substantially rigid structure and may be molded from plastic material, preferably a thermoplastic material, more preferably polypropylene. As shown in FIGS. 7 to 12, the housing (31) is preferably substantially cylindrical shaped having a length along the longitudinal axis (L) of from 10 mm to 200 mm, preferably from 15 mm to 150 mm, more preferably from 20 mm to 100 mm. The cylindrical shaped housing (31) preferably has a diameter of from 5 mm to 40 mm, preferably from 10 mm to 30 mm. However, it should be understood that the housing (31) may have any desired size and shape, such as for example, oval, pyramid, rectangular, etc. However, the size and shape of the housing (31) will, of necessity, be a function of the internal volume needed for the compressible substance. For example, when a higher volume of compressible substance is required, a wider diameter of the housing might be preferred. Preferably, the housing (31) has an inside volume of from 200 $mm^3$ to 250,000 $mm^3$, preferably from 1,500 $mm^3$ to 75,000 $mm^3$. Preferably the compressible substance has a volume of from 1,000 $mm^3$ up to 20,000 $mm^3$, preferably from 1,500 $mm^3$ up to 15,000 $mm^3$, most preferably from 2,000 $mm^3$ up to 10,000 $mm^3$.

Furthermore, the housing (31) comprises at least one inlet opening (33*a*) that provides a flow path for the liquid from the inverted container (2) into the housing (31). Preferably the inlet opening (33*a*) is an opening between the discharge conduit (12) and the valve (20). The phrase "at least one" inlet opening (33*a*) means one or more inlet openings (33*a*) located on the housing (31). For example, it may be desirable to have one larger inlet opening (33*a*) or multiple smaller inlet openings (33*a*). It would be expected that the viscosity and density of the liquid contained inside of the inverted container (2) factors into the design of the size, shape and number of the inlet openings (33*a*). The inlet opening (33*a*) functions as an opening for providing a liquid flow path to establishing fluid communication with the liquid contained inside the inverted container (2) and the housing (31). As shown in FIGS. 7 to 12, the inlet opening (33*a*) is preferably positioned near the bottom of the housing (31) and preferably is rectangular shaped. The inlet opening (33*a*) can have a length of between 1 mm and 25 mm, preferably between 5 mm and 20 mm. The inlet opening (33*a*) can have a height of from 1 mm to 10 mm, preferably from 3 mm to 7 mm.

Other shaped and sized inlet openings (33*a*) can also be operable so long as they can still provide sufficient flow of liquid from the inverted container (2) into the housing (31). For instance, the housing (31) can contain three small circular inlet openings (33*a*) disposed at equal distance near the bottom or one semi-circle surrounding half of the housing (31). Preferably, the inlet opening (33*a*) has a total surface area of from 1 $mm^2$ to 250 $mm^2$, preferably from 5 $mm^2$ to 150 $mm^2$, more preferably from 15 $mm^2$ to 100 $cm^2$.

As shown in FIG. 9, the at least one inlet opening (33*a*) comprises a lower edge (39) proximal to the valve (20) localized in the body (10) and an upper edge (38) distal to the valve (20), such that the at least one inlet opening (33*a*) has an inlet opening height (H), measured parallel to the longitudinal axis L (see FIGS. 3 and 7). The inlet opening (33*a*) preferably has a height (H) of from 0.5 mm to 7.5 mm, more preferably from 1.0 mm to 6.0 mm, more preferably from 1.5 mm to 3.5 mm. Where the housing (31) comprises more than one inlet opening (33*a*), the lower edge (39) is the lower edge (39) which is most proximal to the valve (20), localized in the body (10), and the upper edge (38) is the upper edge (38) which is most distal from the valve (20).

Also it is preferable that the inlet opening (33*a*) is positioned towards the bottom of the housing (31). The lower edge (39) of the at least one inlet opening (33*a*) (that is, the bottom of the at least one inlet opening) can be positioned longitudinally from the upper retainer surface (29*a*) a distance of less than 5.0 mm, preferably less than 4.0 mm, more preferably less than 3.0 mm from the upper retainer surface (29*a*).

As shown in FIG. 9, the housing (31) further comprises at least one outlet opening (33*b*) that provides a path of egress for the liquid from the housing (31) to the exterior atmosphere when the dispensing orifice (23) is opened.

As shown in FIGS. 8 to 12, the housing (31) further comprises a cavity (32). The cavity (32) is a hollow open space inside the housing (31). The cavity (32) is adapted to be partially occupied by a compressible substance. Preferably the compressible substance allows pressure equilibration between the valve interior side (21) and the valve exterior side (22) allowing the dispensing orifice (23) to be/remain reactably closeable. In other words, the compressible substance is to remain uncompressed, prior to "impact" of the inverted container (2), at pressure sufficient to allow the valve (20) to remain closed and retain the liquid inside the inverted container (2). The cavity (32) is also partially occupied by the liquid prior to "impact".

Preferably, the compressible substance is selected from a gas, a foam, a soft matter such as for example a sponge or a balloon, other viscoelastic substance (e.g., polysiloxanes), or a piston, preferably a gas, more preferably air. The compressible substance may comprise a piston (34) (not shown) moveable within the cavity (32) of the housing (31), the piston (34) coupled to a tension member attached to the distal end of the housing (31) and sealingly dividing the cavity (32) into a first (36) and second section (37). When a hydraulic hammer is subjected on the inverted container (2), liquid will flow from the inverted container (2) through the inlet opening (33*a*) into the housing (31). The liquid will press the piston (34) upwards into the cavity (32), compressing the compressible substance in between the piston (34) and the top part of the cavity accordingly, as such decreasing the downwards pressure on the valve (20). After the hydraulic pressure exposure passes, the compressible substance will decompress, moving the piston (34) back downwards and the liquid flows back from the housing (31) through the inlet opening (33*a*) into the inverted container (2).

Alternatively, the compressible substance may comprise a spring-loaded piston (34) (not shown). Here the spring functions as the compressible substance. For example, the volume above the piston (34) is filled with liquid and upon impact the transient hydraulic hammer force compresses the spring connected to the piston (34) causing the liquid in the volume above the piston (34) to evacuate back into the inverted container (2) via a small opening. The net outcome is a resultant net decrease of the downwards pressure on the valve (20) allowing it to remain closed during the impact. After the hydraulic pressure exposure passes, the spring will uncompress, moving the piston (34) back downwards and the liquid flows back from the inverted container (2) through the small opening into the volume above the piston (34).

Alternatively, the compressible substance may comprise a flexible bellow dome (55) (not shown). Here the transient hydraulic hammer force expands the bellow dome (55) causing the cavity (32) of the impact resistance system (30) to fill up with liquid, as such decreasing the downwards pressure on the valve (20). After the hydraulic pressure exposure passes, the flexible bellow dome (55) will deflate, returning the flexible bellow dome (55) to its starting shape and the liquid flows back from the housing (31) through the inlet opening (33*a*) into the inverted container (2). It will be understood that the flexible bellow dome (55) can be made of any flexible materials know to those skilled in the art.

Alternatively, the compressible substance may comprise a gas filled balloon (50) (not shown). Here the transient hydraulic hammer force compresses the balloon (50) allowing the cavity (32) of the impact resistance system (30) to fill up with liquid, as such decreasing the downwards pressure on the valve (20). After the hydraulic pressure exposure passes, the balloon (50) will expand again returning to its starting shape and the liquid flows back from the housing (31) through the inlet opening (33*a*) into the inverted container (2).

Alternatively, the compressible substance may comprise a flexible membrane (51) and a closed cavity (52) (both not shown). Here the transient hydraulic hammer forces the flexible membrane (51) to pop upwards and compresses the air inside the closed cavity (52) and allowing the cavity (32) of the impact resistance system (30) to fill up with liquid, as such decreasing the downwards pressure on the valve (20). After the hydraulic pressure exposure passes, the flexible membrane (51) will return to its starting position and the liquid flows back from the housing (31) through the inlet opening (33*a*) into the inverted container (2).

When the inverted container (2) is impacted, dropped or knocked over, the movement of the liquid inside the inverted container (2) causes an increased transient liquid pressure (i.e., hydraulic pressure hammer). This increased transient liquid pressure travels from the inside of the inverted container (2) through the inlet opening (33*a*) to the housing (31) and the valve interior side (21). The increased transient liquid pressure is of sufficient magnitude to exceed the combined force of the internal resistance force of the valve (20), as discussed herein above, and the opposing exterior atmospheric pressure acting on the valve exterior side (22). This causes the valve (20) to inadvertently open momentarily and leak liquid from the liquid dispenser (1) under such conditions.

The aim of the impact resistance system (30) is to divert the liquid movement (i.e., the increased transient liquid pressure) caused by the impact away from the valve interior side (21) and direct it towards the compressible substance. As shown in FIG. 12, the increased transient liquid pressure compresses the compressible substance in the cavity (32) to absorb the pressure increase allowing for the pressure equilibration between the valve interior side (21) and the valve exterior side (22). As a result, the dispensing orifice (23) is allowed to remain reactably closeable under such conditions, thereby substantially reducing or preventing the tendency of the valve (20) to open during impact. The inventors have discovered that in order to maintain the reactably closeable state for the dispensing orifice (23) the preferred ratio of the volume of the gas, preferably air, inside the housing (31) at a steady state to the volume of the inverted container is higher than 0.001, preferably between 0.005 and 0.05, more preferably between 0.01 and 0.02. Without wishing to be bound by theory it is believed that a minimum compression threshold is desired to significantly reduce or prevent leakage risk under expected exposure conditions during transport or usage. This minimum compression threshold directly correlates with the volume of liquid that can be stored inside the inverted container (2).

For example, larger sized inverted containers (2) can hold larger liquid volumes. When these larger sized inverted containers (2) are impacted, a higher mass of liquid will move upon a hydraulic hammer and as such a higher increased transient liquid force (F=m*a–second law of Newton, with "F" being force, "m" being mass of moving liquid, and "a" being acceleration speed of moving liquid) and hence pressure will be created into the housing (31). As there is a limit towards how much transient pressure can be absorbed per unit of volume of compressible substance, when exceeding that threshold the remaining transient pressure will get translated onto the valve (20), causing leakage accordingly. As such a higher volume of compressible substance is required for higher volumes of liquid into the inverted container (2) to have enough impact resistance buffer to prevent leakage upon an eventual hydraulic hammer exposure.

In some applications, it is preferable to use the liquid dispenser (1) with an optional baffle (40). Preferably the baffle (40), if present, is located between the interior side (21) of the valve (20) and the impact resistance system (30). As shown in FIG. 12, the baffle (40) can include an occlusion member (41) supported by at least one support member (42). Without wishing to be bound by theory, it is believed that the baffle (40) will act as an additional counter-force against the hydraulic hammer, as such further reducing a potential leakage risk. In other words, the baffle (40) functions as a wave breaker to protect the valve (20) from the turbulent kinetic energy of the hydraulic hammer. Suitable custom-made baffles (40) can be obtained from the APTAR Group.

As exemplified in FIGS. 8 to 12, the impact resistance system comprise a wall (60) positioned radially inwardly from the housing (31), extending longitudinally from the body (10), and encircling the valve interior side (21). The wall (60) extends longitudinally from the body (10) into the cavity (32) an overlap distance (O) further than the lower edge (38) of the at least one inlet opening (33*a*), such that the ratio of the overlap distance (O) to the inlet opening height (H) is 1.25 or higher, or from 1.25 to 10, preferably from 1.5 to 7.0, more preferably from 2.0 to 4.0. The wall (60) is preferably annular (cylindrical) in form. The wall (60) can extend longitudinally from the upper retainer surface (29*a*) a distance of from 4.5 mm to 30 mm, preferably from 6.0 mm to 20 mm, more preferably from 7.5 mm to 15 mm.

In addition to improving the resistance to leakage due to hydraulic hammer effects, the dispensers, comprising the wall (60) as described herein, also enable better dosing of smaller volumes, as well as improved leakage prevention, especially for low viscosity liquids.

Inverted Container

It will be evident that the examples of the present disclosure can be used with any type of containers. Preferably, the liquid dispenser (1) is used with the type of inverted container (2) as depicted in FIG. 1.

The inverted container (2), insofar as it has been described, may be of any suitable shape or design so long as it can rest in the upside-down position, the details of which form no part of the present disclosure directed to the liquid dispenser (1). The inverted container (2) can be made of any flexible plastic materials, such as thermoplastic polymers. The flexible materials are compressible enough to deform the inverted container (2) and enable dosing of the liquid yet sufficiently flexible to enable relatively fast shape recovery from the deformation post dosing. Preferably, the flexible plastic materials are polycarbonate, polyethylene (PE), polypropylene (PP), polyvinylchloride (PVC), polyethyleentereftalaat (PET) or the like, or blends or multilayer structures thereof. The flexible plastic material may also container specific moisture or oxygen barrier layers like ethylene vinyl alcohol (EVOH) or the like. The flexible plastic materials may also partially or fully comprise post-consumer recycled materials from bottles, other containers and the like. The inverted container (2) includes an opening (5) (not shown) so as to enable liquid to pass from the inverted container (2) into the liquid dispenser (1). With reference to FIG. 1, the opening (5) (not shown) is situated at the bottom of the inverted container (2). In other words, the inverted container (2) is dosed from the bottom.

Preferably the liquid dispenser (1) does not comprise a closing cap or seal that is suitable for closing the dispensing orifice (23). It is advantageous to not include the closing cap or seal so that the consumer may more easily and quickly dose the liquid from inside the inverted container (2) without bothering with the additional step of opening the cap. Additionally, the closing cap may be accidentally removed from the container (2) or consumers forget to reclose or failed to reclose properly the capon the inverted containers (2) and therefore may fail to prevent liquid leakage.

The inverted container (2) preferably is a squeezable inverted container (2), having at least one, preferably at least two, resiliently deformable sidewall or sidewalls (3). Preferably the inverted container (2) is characterized as having from 5 N to 30 N@15 mm sidewalls deflection, preferably 10 N to 25 N@15 mm sidewalls deflection, more preferably 18 N, @15 mm sidewalls (3) deflection. The inverted container (2) may be grasped by the consumer, and the resiliently deformable sidewall or sidewalls (3) may be squeezed or compressed causing pressure to be applied (also referred to as "applied force") to compress the compressible substance in the space (32). As a result, the increase of the internal pressure causes the liquid between the inverted container (2) and the valve (20) to be dispensed to the exterior atmosphere through the dispensing orifice (23). When the squeezing or compressing force is removed, the resiliently deformable sidewall or sidewalls (3) are released to vent air from the exterior atmosphere to the space (32) to decompress the compressible substance in the space (32) and return the resiliently deformable sidewall or sidewalls (3) to its original shape. Additionally, the venting also refills the cavity (32) of the housing (31) with air from the exterior atmosphere. The vented air moves back into the inverted container (2) via the inlet opening (33*a*) to compensate for the volume of dispensed liquid.

For inverted containers (2), the spring-back of the container (2) after the squeezing force for dispensing has been removed provides the pressure differential to draw air through the orifice (30), so that the container (10) can return to its original shape after squeezing of the container (10). As such, the container has to be sufficiently stiff that it is able to provide sufficient spring-back force to draw air through the orifice (30) and allow the container (10) to return to its original shape. In addition, the container (2) should be sufficiently elastic that pressure differentials between the contents of the container (2) and the atmosphere due to changes in ambient temperature do not result in leakage of the contents of the container (2). As such, the resiliently squeezable container (10) can have an elasticity index of less than 2.5%, or from 0.75% to 1.75%, preferably from 0.85% to 1.4%, as measured using the elasticity index method described herein. The desired elasticity of the resiliently squeezable container (10) can be achieved using any suitable means, including through the selection of the material used for forming the container (10), limiting the wall thickness through using less resin material to make the container (10).

Liquid Detergent Composition

Compositions of use in the present disclosure can be Newtonian or non-Newtonian, preferably Newtonian in the usage shear rate range of from 0.1 $s^{-1}$ to 100 $s^{-1}$. Since the bottom dispensing container (1) is less prone to leakage, the bottom dispensing container (1) is particularly suited for containing liquid compositions, especially liquid detergent compositions, having a viscosity of from 50 mPa·s to 3,000 mPa·s, preferably from 100 mPa·s to 2,000 mPa·s, most preferably from 300 mPa·s to 1,200 mPa·s, measured at a shear rate of 10 $s^{-1}$ following the viscosity test method described herein. The viscosity is measured at 20° C. with a Brookfield RT Viscometer using spindle 31 with the RPM of the viscometer adjusted to achieve a torque of between 40% and 60%. The dispenser described herein, and containers comprising them, are particularly effective for reducing leakage of such low viscosity liquids.

Preferably, the composition has a density between 0.5 g/mL and 2 g/mL, more preferably between 0.8 g/mL and 1.5 g/mL, most preferably between 1 g/mL and 1.2 g/mL.

The surfactant system preferably comprises an anionic surfactant and a co-surfactant. The co-surfactant can be selected from the group consisting of an amphoteric surfactant, a zwitterionic surfactant and mixtures thereof. The surfactant system can comprise the anionic surfactant and co-surfactant in a weight ratio of from 8:1 to 1:1, preferably 4:1 to 2:1, more preferably from 3.5:1 to 2.5:1. Such liquid detergent compositions are particularly suited for use in hand dishwashing applications.

The composition can comprise from 1.0% to 60%, preferably from 5.0% to 50%, more preferably from 8.0% to 45%, most preferably from 15% to 40%, by weight of the total composition of a surfactant system.

The surfactant system can comprise from 40% to 90%, preferably from 65% to 85%, more preferably from 70% to 80%, by weight of the surfactant system of an anionic surfactant. The anionic surfactant is preferably selected from sulphate, sulfonate, sulfosuccinate anionic surfactants, and mixtures thereof. Alkyl sulfate anionic surfactants are especially preferred, either as the sole anionic surfactant, or in combination with a sulfonate anionic surfactant such as alkyl benzene sulfonate. Suitable alkyl sulphate anionic surfactants can be alkoxylated or free of alkoxylation. When alkoxylated, the alkyl sulphate anionic surfactant is preferably ethoxylated. When ethoxylated, the alkyl sulphate anionic surfactant is preferably ethoxylated to a mol average degree of ethoxylation of 2.0 or less, preferably 1.0 or less, more preferably from 0.5 to 1.0.

When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree} = (x1 * \text{alkoxylation degree of surfactant } 1 + x2 * \text{alkoxylation degree of surfactant } 2 + \ldots)/(x1 + x2 + \ldots)$$

wherein x1, x2, . . . are the number of moles of each sulfate anionic surfactant of the mixture and alkoxylation degree is the number of alkoxy groups in each sulfate anionic surfactant.

The alkyl sulphate anionic surfactant preferably has a weight average degree of branching of from 5% to 60%, preferably from 10% to 50%, more preferably from 20% to 40%. This level of branching contributes to better dissolution and suds duration, as well as stability of the detergent composition at low temperature.

The weight average degree of branching is calculated using the following formula:

$$\text{Weight average of branching (\%)} = \left[(x1 * \text{wt \% branched alochol 1 in alcohol 1} + x2 * \text{wt \% branched alcohol 2 in alcohol 2} + \ldots)/(x1 + x2 + \ldots)\right] * 100$$

wherein x1, x2, are the weight in grams of each alcohol in the total alcohol mixture of the alcohols which were used as starting material for the anionic surfactant. In the weight average branching degree calculation, the weight of anionic surfactant components not having branched groups is also be included.

The alkyl sulphate anionic surfactant can have an average alkyl chain length of from 8 to 16, preferably from 12 to 15, more preferably from 12 to 14.

Suitable examples of commercially available sulfates include, those based on Neodol alcohols ex the Shell company, Lial—Isalchem and Safol® ex the Sasol company, natural alcohols ex The Procter & Gamble Chemicals company. Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS); methyl ester sulfonate (MES); and alpha-olefin sulfonate (AOS). Those also include the paraffin sulfonates may be monosulfonates and/or disulfonates, obtained by sulfonating paraffins of 10 to 20 carbon atoms. The sulfonate surfactant can also include alkyl glyceryl sulfonate surfactants.

The composition can further comprise a co-surfactant selected from the group consisting of an amphoteric surfactant, a zwitterionic surfactant and mixtures thereof, as part of the surfactant system. The composition preferably comprises from 0.1% to 20%, more preferably from 0.5% to 15% and especially from 2% to 10% by weight of the cleaning composition of the co-surfactant.

The surfactant system of the cleaning composition of use in the present disclosure preferably comprises from 10% to 40%, preferably from 15% to 35%, more preferably from 20% to 30%, by weight of the surfactant system of a co-surfactant. The surfactant system preferably comprises anionic surfactant and the co-surfactant in a weight ratio of from 8:1 to 1:1, preferably 4:1 to 2:1, more preferably from 3.5:1 to 2.5:1.

The co-surfactant is preferably an amphoteric surfactant, more preferably an amine oxide surfactant. The amine oxide surfactant can be selected from the group consisting of: alkyl dimethyl amine oxide, alkyl amido propyl dimethyl amine oxide, and mixtures thereof. Alkyl dimethyl amine oxides are preferred, such as C8-18 alkyl dimethyl amine oxides, or C10-16 alkyl dimethyl amine oxides (such as coco dimethyl amine oxide). Suitable alkyl dimethyl amine oxides include C10 alkyl dimethyl amine oxide surfactant, C10-12 alkyl dimethyl amine oxide surfactant, C12-C14 alkyl dimethyl amine oxide surfactant, and mixtures thereof. C12-C14 alkyl dimethyl amine oxide are particularly preferred.

Suitable zwitterionic surfactants include betaine surfactants. Such betaine surfactants includes alkyl betaines, alkylamidobetaine, amidazoliniumbetaine, sulfobetaine (INCI Sultaines) as well as the phosphobetaine. The most preferred zwitterionic surfactant is cocoamidopropylbetaine.

The surfactant system can further comprise from 1% to 25%, preferably from 1.25% to 20%, more preferably from 1.5% to 15%, most preferably from 1.5% to 5%, by weight of the surfactant system, of an alkoxylated non-ionic surfactant.

Preferably, the alkoxylated non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol.

Alternatively, or in addition, the compositions can comprise alkyl polyglucoside ("APG") surfactant, to improve sudsing beyond that of comparative nonionic surfactants such as alkyl ethoxylated surfactants. If present, the alkyl polyglucoside can be present in the surfactant system at a level of from 0.5% to 20%, preferably from 0.75% to 15%, more preferably from 1% to 10%, most preferably from 1% to 5% by weight of the surfactant composition.

The liquid detergent compositions of use in the present disclosure can comprise various performance additives, such as cleaning polymers, polyamines, salts, hydrotropes, organic solvent, and mixtures thereof.

Suitable cleaning polymers include soil release polymers such as amphiphilic polymers, especially amphiphilic alkoxylated polymers. Suitable polyamines include cyclic polyamines, such as those selected from the group consisting of 2-methylcyclohexane-1,3-diamine, 4-methylcyclohexane-1,3-diamine and mixtures thereof.

The cleaning composition can have a pH of from 5 to 12, more preferably from 7.5 to 10, as measured at 10% dilution in distilled water at 20° C. The pH of the composition can be adjusted using pH modifying ingredients known in the art.

Suitable cleaning compositions are described in European Application EP3511402.

TEST METHODS

The following assays set forth must be used in order that the examples described and claimed herein may be more fully understood.

Leakage Under Impact

Figure 13:
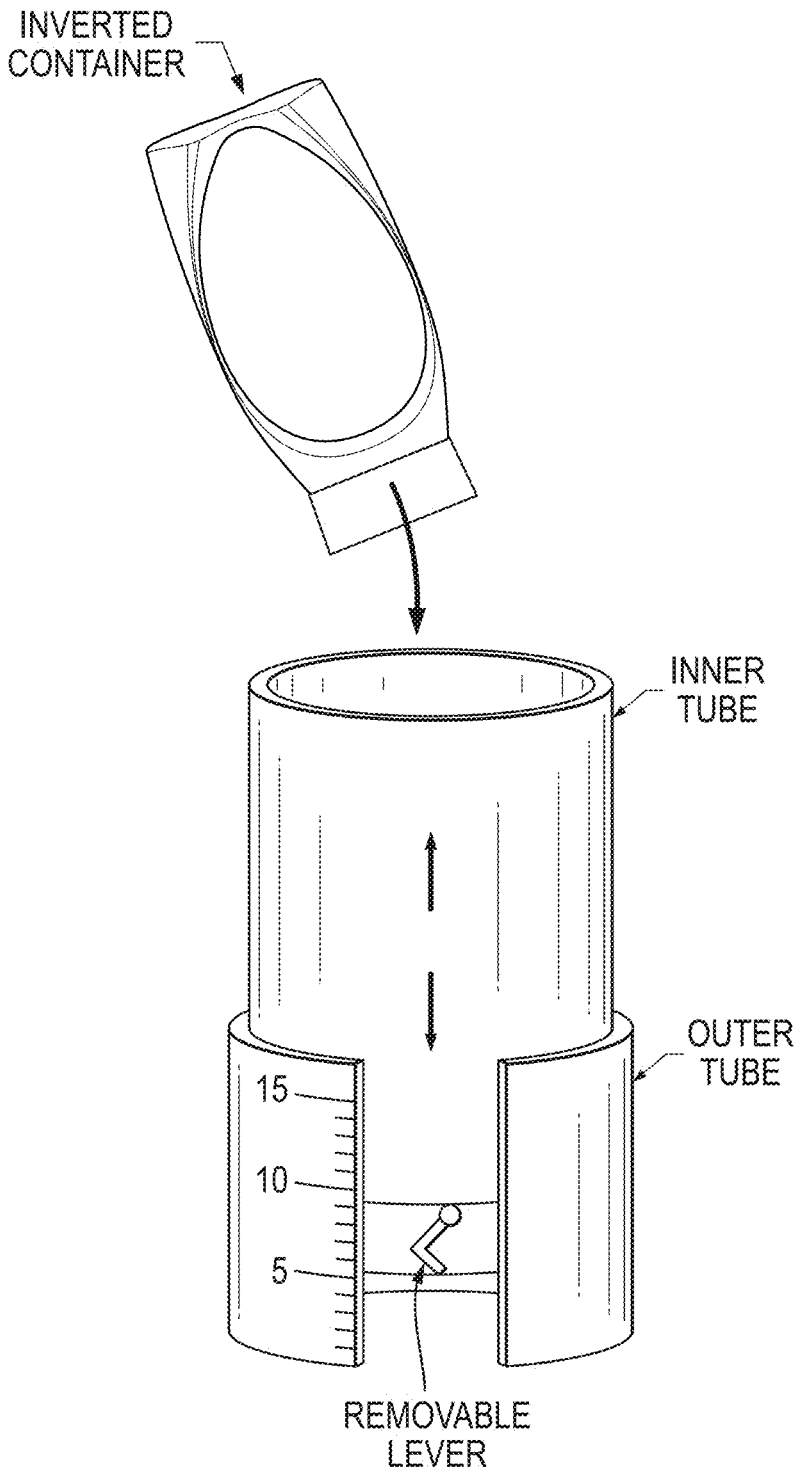
FIG. 13 shows a drop tester apparatus and the procedures in the Leakage Resistance Test.

The purpose of this test is to assess the ability of a liquid dispenser to prevent leakage of the liquid from an inverted container during "impact". The impact occurs when the inverted container is dropped, liquid dispenser side down, from a certain height onto a flat surface. The drop is supposed to mimic the resulting transient liquid pressure increases upon impact inside the inverted container. The leakage resistance ability of the liquid dispenser is evaluated through measurement of the drop height till which no volume/weight of the liquid leaks out when dropped. A higher leak-free drop height correlates to better leakage resistance ability for the liquid dispenser. The steps for the method are as follows:

1. Use a drop tester apparatus as shown in FIG. 13. The apparatus consists of two top and bottom open ended cylindrical tubes with an approximate diameter of 12 cm, i.e. an outer tube tightly surrounding an inner tube movable in vertical direction into the outer tube, the outer tube having a cut out section to enable visual assessment of the relative height of the inner tube within the outer tube through a grading scale applied on the outer tube. A removable lever is applied at the bottom of the inner tube, allowing an inverted container (2) positioned with its opening downwards within the inner tube to rest on the lever. When the lever is manually removed the inverted container drops down and the amount of leaked liquid after the exposure is weighed. Therefore a piece of paper is positioned on a hard surface at the bottom of the open ended outer container to capture the leaked liquid. The weight of the paper is measured on a balance prior and after the drop test to define the amount of leaked liquid. The height at which the lever was positioned prior to manual removal is measured as the drop height.

2. Fill an inverted container (2) having a defined volume (e.g., 400 mL or 650 mL) with a standard liquid dishwashing detergent having a density of 1.03 g/mL and a Newtonian viscosity of 1000 cps at 20° C. when measured on a Brookfield type DV-II with a spindle 31 at rotation speed 12 RPM to a defined fill level within the inverted container. For example, with a 400 mL inverted container fill with 400 mL of liquid dishwashing detergent, and with a 650 mL inverted container fill with 650 mL of liquid dishwashing detergent. The liquid fill level, inverted container volume and liquid composition is kept constant when cross-comparing different closing systems.
3. Assemble a liquid dispenser comprising a valve (Simplicity 21-200 "Simplisqueeze®" valve available from Aptar Group, Inc.) with the inverted container (2), as shown in FIGS. 4 to 6. The liquid dispenser has a frustoconical shaped exterior portion (e.g., bottom diameter 65 mm, top diameter 34 mm and height 30 mm) for resting on the flat surface, and optionally fitted with an internally developed baffle (e.g., diameter 7 mm, 5 ribs emerging from center ball of 4 mm to the outside), an impact resistance system (30) according to the present disclosure or both.
4. Set up the drop height (from 2 cm to 15 cm) on the drop tester.
5. Cut a piece of paper approximately 7 cm×7 cm for fitting the opening at the lower end of the outer tube.
6. Weigh the piece of paper using a Mettler Toledo PR1203 balance and record its weight.
7. Place the piece of paper under the opening at the lower end of the outer tube.
8. Place the assembled liquid dispenser and inverted container (2), liquid dispenser side down, into the inner tube of the drop tester.
9. Pull back the lever in the drop tester in a quick and smooth motion.
10. Remove the tubes and the assembled liquid dispenser and inverted container from the drop tester.
11. Weigh the piece of paper a second time and record the weight. Calculate the weight difference of the paper, and the delta corresponds to the amount of liquid leaked from the liquid dispenser.
12. Repeat steps 5 to 11 four more times for a total of five replicates for each test condition.
13. Calculate the average maximum drop height at which no liquid leaked.

Immersed Volume, Overflow Volume and Elasticity Index

The test is done on containers which are at least 3 days old, in order to avoid the effects of container shrinkage after making. The test is done at a room temperature of 20° C. and a room atmospheric pressure of 1013+/−1 Pa.

Distilled water having a density of 1.000+/−0.002 g/ml, when measured at 20° C. is added to a beaker of volume at least 5 L. If desired, a dye may be added to improve visibility, so long at the target density is achieved.

The container is weighed using a laboratory balance having an accuracy of 0.001 g.

The container is then fully immersed in the beaker, with the opening facing up with the distilled water in the beaker at 20° C., expelling any remaining air in the container by gentle shaking. Holding the container by the stiffest part of the neck, the container is carefully lifted out of the beaker while avoiding squeezing of the container and spilling any of the solution. The filled container is wiped dry and re-weighed on the balance, in order to measure the weight of solution contained in the container when the container was immersed. From the weight of the distilled water, the immersed volume (ml) can be deduced. The container is then topped up to the brim with additional distilled water at 20° C. and the container reweighed, in order to measure the weight of the distilled water contained within the container after topping up to the brim. From this weight of surfactant solution, the overflow volume can be deduced. The overflow volume is the total volume of the distilled water contained in the container after topping up. The time between immersion in the basin and weighing must be less than 2 minutes.

The elasticity index is calculated using the following equation, expressed as a percent:

$$\text{Elasticity index} = \frac{\text{Overflow volume} - \text{Immersed volume} \times 100\%}{\text{Immersed volume}}$$

Peak Pressure

The peak pressure is the pressure within the empty container at a defined temperature above the fill temperature. A temperature and pressure probe (preferably MSR145B4 data logger) is placed within the empty container and the container is capped with a sealingly engaged cap (without an orifice), with the container maintained at a temperature of 20° C. and an atmospheric pressure of 1013+/−1 Pa, while ensuring that no additional pressure beyond the surrounding atmospheric pressure is exerted on the container during capping. The container is placed within a constant temperature oven, set at the desired temperature for 4 hours at 1013+/−1 Pa and the maximum (peak) pressure logged by the temperature and pressure probe is recorded. The method is repeated using 5 different containers and the average peak pressure is recorded.

Leakage Due to Pressure Changes

The containers are filled to 10% of the container size (recommended fill volume) at 20° C. with Fairy® original dark green dishwashing product having a viscosity in the range of 1,000+/−200 mPa·s, measured at a shear rate of 10 $s^{-1}$ (for example, Belgian market product, 2018), and the containers sealed with caps comprising V21-145 slit-valves (supplied by Aptar). Cups are weighed before the containers are placed upside down in the cups, with the container cap positioned a distance from the bottom of the cup. The containers are then placed, with the cups in a constant temperature oven kept at 40° C. The containers and cups are then removed from the oven after an hour, the container removed from the cup and the cup reweighed, in order to measure the weight of product that has leaked from the container.

Minimum Dosage

The dosing control method provides a method to determine the ease of dosing small volumes. For the test, the commercially available "Joy®" dishwashing 330 ml container, as sold in Japan in October 2023, is preferably used. However, alternative containers having a cylindrical volume of a similar volume can be used, as the method provides a comparative dosing assessment for the different dispensers being compared. Improved dosing is signified by a reduced minimum dosage delivered during the test.

The container is filled with 210 g of a liquid composition having an essentially Newtonian viscosity of 160 mPa·s in the shear rate range of from 0.1 $s^{-1}$ to 100 $s^{-1}$, such as the "Joy® dishwashing detergent sold by Procter & Gamble in Japan in October 2023. The bottle is then squeezed and kept as such while the dispenser is fitted to the container before the assembled bottle is inverted and the squeezing pressure released. The container is allowed to recover its shape by drawing air through the dispenser orifice and left for 5 minutes to ensure equilibration.

A container is placed on a microbalance (at least 0.01 g accuracy) and the bottle is positioned above the container at a height of approximately of 80 mm. The container is then squeezed slowly to dispense the smallest possible dosage and the weight of the dose is measured using the microbalance.

The test is repeated 5 times and the dosage values are averaged over the 5 attempts.

EXAMPLES

Dispensers according to FIG. 12 were made via 3D printing for the comparative test, having an inlet opening height (H), and an overlap distance (O), and ratio of the overlap distance (O) to the inlet opening height (H) as described in table 1. The resultant minimum dosage that could be achieved from the dispensers is also given in table 1.

TABLE 1

Comparative test of different inlet opening heights (H), and overlap distances (O), and hence ratio of the overlap distance (O) to the inlet opening height (H), and the resultant minimum dosage, as measured using the test method described herein:

| Ex | inlet opening height (H) | overlap distance (O) | ratio of the overlap distance (O) to the inlet opening height (H) | Minimum dosage |
|---|---|---|---|---|
| A* | 2.36 | 2.86 | 1.21 | 1.20 |
| 1 | 2.36 | 4.86 | 2.06 | 1.13 |
| 2 | 2.36 | 7.86 | 3.33 | 1.00 |
| 3 | 2.36 | 10.36 | 4.39 | 0.72 |

*Comparative

As can be seen from the data above, the minimum dosage obtainable from the dispenser is reduced as the ratio of the overlap distance (O) to the inlet opening height (H) is increased, which demonstrates the improved dosage control of the dispensers of the present disclosure.

All percentages and ratios herein are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any example disclosed or claimed herein or that it alone, or in any combination with any other reference or references, teaches, suggests or discloses any such example. Further, to the extent that any meaning or definition of a term in this document conflicts with any meaning or definition of the same term in a document incorporated by reference, the meaning or definition assigned to that term in this document shall govern.

While particular examples of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of the present disclosure.

What is claimed is:

1. A liquid dispenser for affixing to an inverted container containing dispensable liquid, the dispenser comprising:

a body of the dispenser comprising a connecting sleeve, wherein the connecting sleeve is adaptable for engaging to an exterior surface proximate an opening of the inverted container and a space radially inward from the connecting sleeve, the space defining an internal discharge conduit for establishing fluid communication with the liquid contained in the inverted container;

a valve localized in the body extending across the internal discharge conduit, the valve having an interior side for being contacted by the liquid contained inside the inverted container and an exterior side for being exposed to the exterior atmosphere, wherein the valve defines a dispensing orifice that is reactably openable when the pressure on the valve interior side exceeds the pressure on the valve exterior side; and an impact resistance system localized upstream of the valve, the system comprises: a housing having a cavity therein and extending longitudinally from the body and radially inwardly from the sleeve;

wherein the housing comprises at least one inlet opening that provides a flow path for the liquid from the inverted container into the housing, and at least one outlet opening that provides a path of egress for the liquid from the housing to the exterior atmosphere when the dispensing orifice is opened, wherein the cavity is adapted to be partially occupied by a compressible substance, wherein the at least one inlet opening comprises a lower edge proximal to the body and an upper edge distal to the body, such that the at least one inlet opening has an inlet opening height (H), characterized in that:

the impact resistance system further comprises a wall positioned radially inwardly from the housing, extending longitudinally from the body, and encircling around the valve interior side, and the wall extends longitudinally from the body an overlap distance (O) further than the lower edge of the at least one inlet opening, wherein a ratio of the overlap distance (O) to the inlet opening height (H) is 1.25 or higher.

2. The liquid dispenser according to claim 1, wherein the housing has an internal volume of from about 200 $mm^3$ to about 250,000 $mm^3$.

3. The liquid dispenser according to claim 1, wherein the housing has an internal volume of from about 1,500 $mm^3$ to about 75,000 mm3.

4. The liquid dispenser according to claim 1, wherein the inlet opening has a total surface area of from about 1 $mm^2$ to about 250 $m^2$.

5. The liquid dispenser according to claim 1, wherein the inlet opening has a total surface area of from about 5 $mm^2$ to about 150 $m^2$.

6. The liquid dispenser according to claim 1, wherein the inlet opening has a height (H) of from about 0.5 mm to about 7.5 mm.

7. The liquid dispenser according to claim 6, wherein the inlet opening has a height (H) of from about 1.0 mm to about 6.0 mm.

8. The liquid dispenser according to claim 1, wherein the ratio of the overlap distance (O) to the inlet opening height (H) is from about 1.25 to about 10.

9. The liquid dispenser according to claim 8, wherein the ratio of the overlap distance (O) to the inlet opening height (H) is from about 1.5 to about 7.0.

10. The liquid dispenser according to claim 1, wherein the body or the housing comprises an upper retainer surface, and the lower edge of the at least one inlet opening is positioned longitudinally from the upper retainer surface a distance of less than about 5.0 mm from the upper retainer surface.

11. The liquid dispenser according to claim 1, wherein the body or the housing comprises an upper retainer surface, and the wall extends longitudinally from the upper retainer surface a distance of from about 4.5 mm to about 30 mm.

12. The liquid dispenser according to claim 11, wherein the internal resistance force of the valve is less than about 250 mbar.

13. The liquid dispenser according to claim 1, wherein the housing comprises of a plastic material.

14. The liquid dispenser according to claim 1, wherein an internal resistance force of the valve is at least about 10 mbar to open the dispensing orifice.

15. The liquid dispenser according to claim 11, wherein an internal resistance force of the valve is less than about 250 mbar.

16. The liquid dispenser according to claim 1, wherein the body comprises at a bottom end (B) an exterior portion adapted for resting the inverted container on a flat surface in the upsidedown position.

17. The liquid dispenser according to claim 1, further comprising a baffle located in between the interior side of the valve and the impact resistance system.

18. The liquid dispenser according to claim 17, wherein the baffle includes an occlusion member supported by at least one support member.

19. The inverted container according to claim 17, wherein the inverted container comprises a liquid detergent composition, wherein the liquid detergent composition has a viscosity of from about 50 mPa·s to about 3,000 mPa·s measured at a shear rate of about 10 $s^{-1}$, wherein the viscosity is measured at about 20° C. with a Brookfield RT Viscometer using spindle 31 with the RPM of the viscometer adjusted to achieve a torque of between about 40% and about 60%.

20. An inverted container comprising the liquid dispenser according to claim 1, wherein the liquid dispenser does not comprise a closing cap or seal.

* * * * *